US005145179A

United States Patent [19]

Breed

[11] Patent Number: 5,145,179

[45] Date of Patent: Sep. 8, 1992

[54] GOLF PUTTING TRAINING DEVICE

[76] Inventor: Michael S. Breed, 1310 Bon Air Dr., Augusta, Ga. 30907

[21] Appl. No.: 787,242

[22] Filed: Nov. 4, 1991

[51] Int. Cl.[5] ..... A63B 69/36

[52] U.S. Cl. ..... 273/189 R; 273/DIG. 30; 273/183 B

[58] Field of Search ..... 273/189 R, 183 B, 189 A, 273/190 R, 190 A, 190 B, 188 R, 190 C, DIG. 30; 119/126, 127, 128

[56] References Cited

U.S. PATENT DOCUMENTS

| | | | |
|---|---|---|---|
| 5,040,798 | 8/1991 | Leitao | 273/189 R |
| 5,067,587 | 12/1991 | Manley | 273/183 B |
| 5,085,437 | 2/1992 | Leitao | 273/183 B |

OTHER PUBLICATIONS

"Golf Digest", p. 68, Nov. 1974.

*Primary Examiner*—George J. Marlo
*Attorney, Agent, or Firm*—Salter, Michaelson & Benson

[57] ABSTRACT

A golf putting training device includes a laterally adjustable spacing member, a pair of pivotally adjustable forearm bracing members attached on opposing ends thereof, and an adjustable strap on one of the bracing members for securing the training device to the user's forearm. The training device is adjustable to the varying spacial and angular alignments of the user's forearms and can be adjusted to accommodate a plurality of different user's forearms for use during the putting stroke. The adjustable training device correctly positions the forearms in spaced relation, and effectively stabilizes them, thus preventing relative motion with respect to one another during the putting stroke.

6 Claims, 2 Drawing Sheets

GOLF PUTTING TRAINING DEVICE

BACKGROUND OF THE INVENTION

The present invention relates to a golf practice device and more specifically to a golf putting training device.

It is understood in the play of the game of golf that putting is one of the more fundamental and important aspects in obtaining a low score. However, in order to become a proficient putter, a golfer must utilize a consistent putting stroke that produces a roll of the ball along a preselected path. Such a stroke often takes years of practice to develop.

It is also recognized that the most effective putting stroke is a pendulum-like motion in which the putters' arms are moved together, the pendulum-like putting motion originating in the putter's shoulders. Generally, the larger shoulder muscles of the upper body are much more controllable than the smaller arm muscles and therefor provide better control of the motion of the putter during the putting stroke. However, many golfers who attempt to develop the described pendulum putting stroke often have problems correctly positioning their arms and wrists, and further have problems maintaining their arms and wrists in a stable fixed position relative to one another during the putting stroke. As a result, relative arm and wrist motion occurs during the putting stroke which produces an inconsistent stroke path and therefore inconsistent results.

SUMMARY OF THE INENTION

The present invention is directed to a golf putting training device that engages the forearms of the user so as to correctly position the user's forearms and wrists in fixed relation and further stabilizes the forearms and wrists to prevent relative motion thereof during the putting stroke. Briefly, the invention comprises an adjustable spacing member, a pair of forearm bracing members pivotally attached on opposing ends of the spacing member and a strap attached to one of the forearm bracing members for securing the training device to a forearm of the user. The spacing member includes a pair of adjustable telescoping tubes which are lockable in a plurality of spaced positions. The bracing members are also pivotally adjustable and include a locking mechanism for the securement thereof in a plurality of angular positions.

It is therefor an object of the present invention to provide a golf putting training device which correctly positions the users forearms and wrists in fixed relation. and thereby stabilizes the users forearms and wrists relative to one another for producing a consistent pendulum like putting stroke.

It is another object of the present invention to provide a golf putting training device which is adjustable to the varying spacial and angular alignments of the forearms of the user.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENTS

Figure 1:
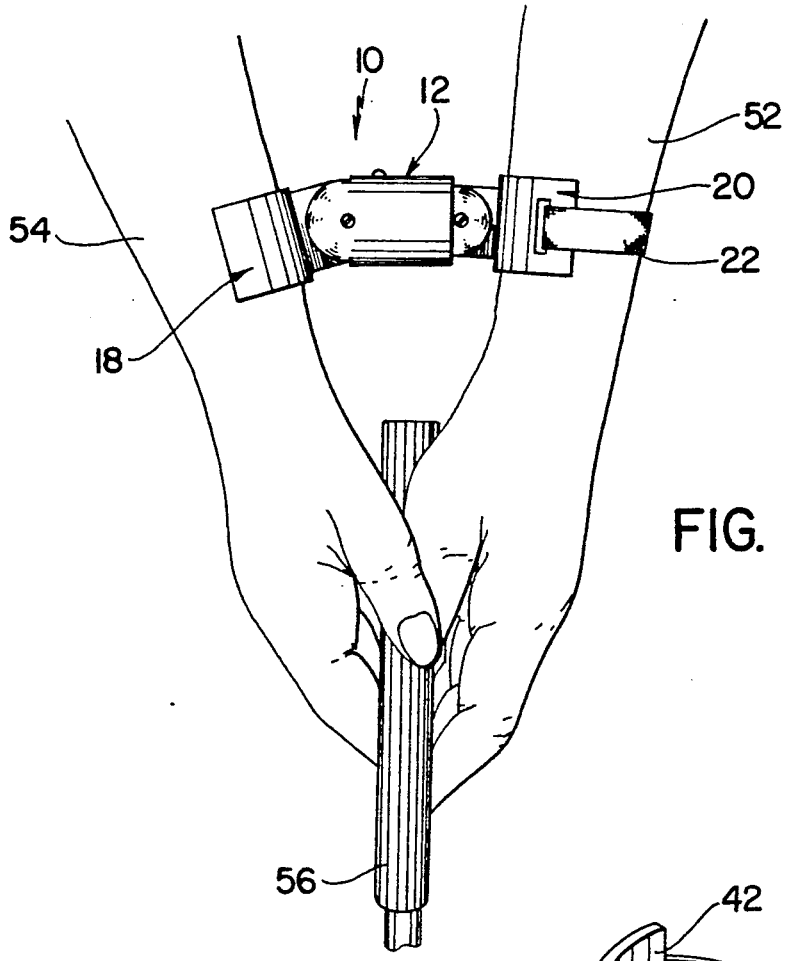
FIG. 1 is a front elevational view of the golf putting training device of the instant invention showing the device as mounted on the forearms of a user.
Figure 2:
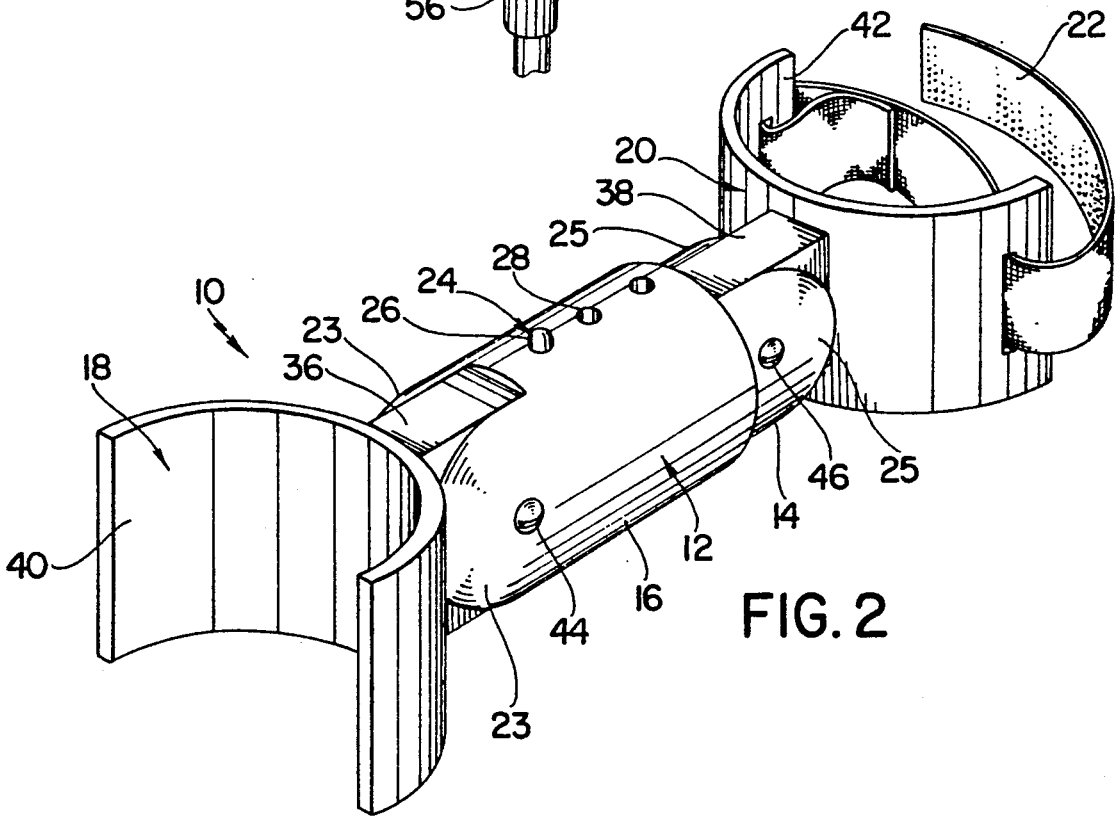
FIG. 2 is a perspective view thereof wherein one form of a lateral adjusting mechanism is illustrated.
Figure 3:
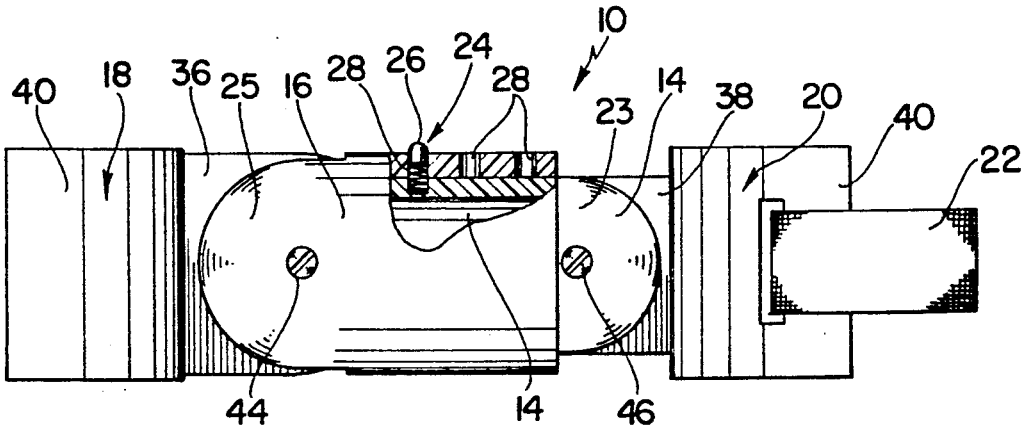
FIG. 3 is a side elevation with parts shown in section showing the lateral adjusting mechanism as illustrated in FIG. 2.

Referring now to the drawings and particularly to FIGS. 1 through 3, the golf putting training device as embodied in the present invention is illustrated and is generally indicated at 10. As shown more clearly in FIG. 2, the golf putting training device 10 includes an adjustable central spacing member generally indicated at 12, a pair of forearm bracing members generally indicated at 18 and 20, and an adjustable attaching strap 22 that is mounted on the forearm bracing member 20. Referring now to FIG. 3, the central spacing member 12 is shown comprising inner and outer telescoping tubes 14 and 16 which in the form of the device illustrated are lockable in a plurality of preselected spaced positions with the selected position being dependent on the location of the device on the forearms of the user. The inner ends of the telescoping tubes 14 and 16 are dimensioned for sliding communication and the outer ends thereof are formed with spaced apart semi-circular portions 23 and 25, respectively, that provide for pivoting of the forearm bracing members 18 and 20 relative thereto, as will be described.

As shown in FIGS. 2 and 3, one form of an adjustment locking mechanism is illustrated for locking the telescoping tubes 14 and 16 in a selected adjusted position and includes a plunger locking mechanism generally indicated at 24. The plunger locking mechanism 24 includes a spring biased plunger 26 that is received in an appropriate bore formed in the wall of the inner tube 14. Formed in the wall of the outer tube 16 are a plurality of openings 28 that are provided for selectively receiving the plunger 26 in engagement therein. It is seen that the length of the central spacing member 12 is varied depending upon the requirements of the user by locating the plunger 26 in a selected opening 28 as the telescoping tubes 14 and 16 are adjustably moved with respect to each other.

Figure 4:
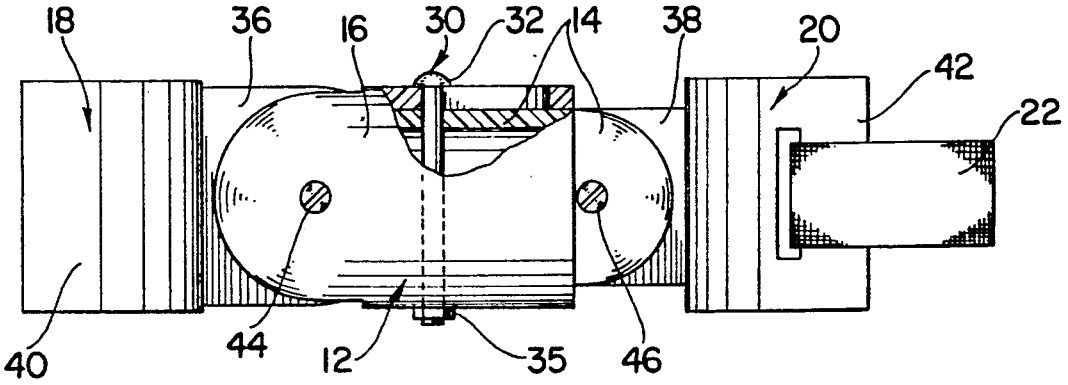
FIG. 4 is a view similar to that shown in FIG. 3, but illustrating a modified form of the lateral adjusting mechanism.
Figure 5:
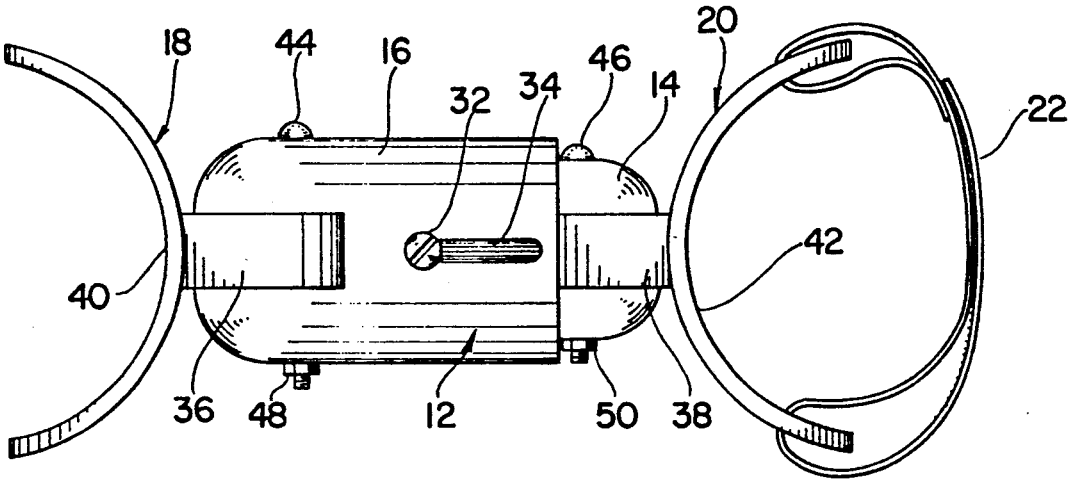
FIG. 5 is a top elevational view of the device illustrated in FIG. 4, showing the modified form of the lateral adjusting mechanism.

Referring now to FIGS. 4 and 5, a modified form of the lateral adjustment device for the central spacing member 12 is illustrated and includes a set bolt locking mechanism generally indicated at 30. In the form of the device illustrated in FIGS. 4 and 5, the tube 14 has a set bolt 32 anchored therein, the outer tube 16 having a longitudinal extending slot 34 formed in the wall thereof. The set bolt 32 extends through the longitudinal slot 34 and include a lock nut 35 that is operative for locking the telescoping tubes 14 and 16 in a plurality of spaced positions.

As shown in FIG. 1, the longitudinal axis of the central spacing member 12 is disposed in angular relation with respect to the forearm bracing members 18 and 20. Since the desired angular relation between the central spacing member 12 and the bracing members 18 and 20 will vary with each user, the forearm bracing members 18 and 20 includes projecting portions 36 and 38, respectively, that are joined in fixed relation to curved bracing portions 40 and 42, respectively. The projecting portions 36 and 38 are pivotally secured to the outer curved ends of the telescoping tubes 14 and 16 by set bolts 44 and 46, and lock nuts 48 and 50 that are mounted on the set bolts 44 and 46, respectively. It is seen that the bracing members 18 and 20 are pivotable about the set bolts 44 and 46 for angular adjustment thereof with respect to the forearms of the user.

In order to mount the training device 10 in a position of use, the adjustable strap 22, which is preferably formed of a Velcro-type material, is attached to the curved bracing portion 42 and extends through the suitable openings as formed therein. A free end of the strap 22 is securable to a portion of the strap that is formed with a complimentary Velcro material.

Referring again to FIG. 1, the training device 10 is shown positioned between the forearms of the user. In this connection, the left forearm of the user indicated at 52 is received in engagement with the bracing portion 42 and the strap 22 is secured therearound for fixing the device thereon. The right forearm of the user indicated at 54 is received in engagement with the bracing portion 40 and is retained thereon by exerting pressure of the forearm 54 thereagainst. The telescoping tubes 14 and 16 are laterally adjustable to the spacing of the user's forearms, and bracing members 18 and 20 are pivotally adjustable to the angular alignment of the user's forearms. In use of the device the user grasps a putter 56 at the upper end thereof with both hands in the conventional manner. The training device 10, which engages the inside of the forearms of the user, correctly positions the forearms in spaced relation and in effect stabilizes them with respect to each other. As the user makes a putting stroke, the forearms are prevented from relative movement thereof and allow the user to feel and develop the proper pendulum putting motion.

It is seen that the present invention provides an effective golf putting training device for correctly positioning the user's forearms in spaced relation and thereafter stabilizing the forearms relative to one another during the putting stroke. The spacing member 12 and the bracing members 18 and 20 are specifically adapted for securely engaging and positioning the forearms of the user in spaced relation, and may be adjusted to the varying spacial and angular alignments of the user's forearms in order to promote the desired pendulum putting stroke. After using the practice putting device for a period of time the user becomes accustomed to the feel of the proper pendulum putting stroke, and when putting without the device will continue to affect the proper stroke as taught by the subject invention.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A golf putting training device comprising:

a lateral spacing member having opposite disposed ends, said spacing member including means for adjustably locating said ends in selected spaced apart positions nd further including means for locking said ends in said selected spaced apart positions;

a pair of forearm cracking members each of which is joined to an end of said spacing member for engagement with a forearm of the user, wherein the forearms of the user are located in a spaced apart relation, and are prevented from relative movement thereof during a putting stroke; means for pivotally adjusting said cracking members around a horizontally disposed axis and further including means for locking said cracking members in a plurality of angular adjustments relative to said spacing member and said forearms; and means for releasably attaching said training device to one of the forearms of the user.

2. A golf putting training device as claimed in claim 1, said attaching means comprising adjustable strap means that is secured to one of said bracing members.

3. A golf putting device as claimed in claim 2, said adjustable strap means including, opposing interlocking materials for securing said strap means in place around the forearm on which the device is mounted.

4. A golf putting training device as claimed in claim 1, said means for adjustably locating said ends in selected spaced apart position including inner and outer telescoping tubes, each of which has an end of said spacing member formed thereon, said telescoping tubes being adjustable relative to each other to adjust the position of said bracing members relative to the forearms of the user.

5. A golf putting training device as claimed in claim 4, said means for locking said ends in a plurality of spaced apart positions comprising a spring biased plunger positioned within said inner telescoping tube and a plurality of longitudinally spaced openings formed in said outer telescoping tube for receivable engagement with said plunger and for locking said telescoping tubes relative to one another.

6. A golf putting training device as claimed in claim 4, said means for locking said end in a plurality of spaced apart positions comprising a longitudinal slot formed in said outer telescoping tue and a set bolt positioned within said inner telescoping tube and communicating with said slot of blocking said telescoping tubes relative to one another.

* * * * *